United States Patent [19]

Djordjevic

[11] Patent Number: 4,550,702

[45] Date of Patent: Nov. 5, 1985

[54] SPILL CONTROL SYSTEM FOR DISTRIBUTOR PUMP

[75] Inventor: Ilija Djordjevic, Windsor, Conn.

[73] Assignee: Stanadyne, Inc., Windsor, Conn.

[21] Appl. No.: 658,288

[22] Filed: Oct. 5, 1984

[51] Int. Cl.[4] ..... F02M 39/00

[52] U.S. Cl. ..... 123/450; 123/506; 417/462

[58] Field of Search ..... 123/506, 450, 459; 417/462

[56] References Cited

U.S. PATENT DOCUMENTS

| | | | |
|---|---|---|---|
| 4,362,141 | 12/1982 | Mowbray | 123/450 |
| 4,376,432 | 3/1983 | Davis | 123/501 |
| 4,397,615 | 8/1983 | Mowbray | 123/450 |
| 4,457,277 | 7/1984 | Adey | 123/450 |

*Primary Examiner*—Magdalen Y. C. Moy

*Attorney, Agent, or Firm*—Prutzman, Kalb, Chilton & Alix

[57] ABSTRACT

A spill control system for a distributor pump employs an axially positionable valve member to control the passage of diverted fuel through a spill passage. The valve member is axially displaced by an actuator pin mounted to the cam ring which actuates the pump plungers. A cam surface which rotates with the pump rotor engages the actuator pin. The valve member is also angularly positionable for controlling the passage of diverted fuel. The diverted fuel is spilled to the housing interior or in one embodiment may be recouped and redirected to the fuel inlet passage in the rotor. A check valve is employed to prevent the passage of diverted fuel until the injection pressure of the diverted fuel exceeds a pressure in excess of the maximum transfer pressure of the pump.

28 Claims, 9 Drawing Figures

SPILL CONTROL SYSTEM FOR DISTRIBUTOR PUMP

BACKGROUND OF THE INVENTION

This invention relates generally to fuel injection pumps of a type adapted to deliver discrete charges of pressurized fuel to the cylinders of an associated internal combustion engine. More particularly, this invention relates to an adjustable spill control system for diverting a portion of a pressurized fuel charge to supply an accurately quantified fuel charge to the associated engine.

Fuel injection pumps which employ a pair of plungers reciprocating in a diametral bore of a rotatable rotor to generate pressurized charges of fuel for delivery to the cylinders of an associated internal combustion engine are well known. Such fuel injection pumps conventionally employ a cam ring having a plurality of lobes which are operatively engageable with the plungers for reciprocating the plungers upon rotation of the rotor. The timing of the reciprocating plungers is controlled by adjusting the angular position of the cam ring. A number of systems have been advanced for regulating the size of the injected fuel charge by means of diverting a portion of a pressurized fuel charge from the fuel distributor path which leads from the pump chamber to discharge passages in the rotor for ultimate distribution to the internal combustion engine. Such mechanical spilling systems have employed either angularly or axially acting spill collars or spill valves within the fuel injection pump to divert fuel to the interior of the pump. An example of a spill control system is exemplified in U.S. Pat. No. 4,376,432 entitled "Fuel Injection Pump With Spill Control Mechanism" wherein a spill collar is mounted adjacent to the cam ring. The spill collar includes a spill port for diverting fuel flow from the charge pump upon registration of a spill passage formed in the rotor with the spill port of the spill collar. Means are provided for adjusting the angular position of the spill collar relative to the cam ring to control the quantity of diverted fuel.

Conventional spill control systems have proved problematical because of difficulties in independently controlling the fuel delivery and the timing advance. The latter difficulties arise from the mechanical connection via the conventional cam ring between the fuel delivery means and the timing advance means. One solution employs a longer cam ramp. However, the latter solution tends to increase dead volume trapped between the pumping plungers. The dead volume is especially critical at high speeds when earlier advances are required and higher pressures generated. Of course, additional filling of the pump chamber is required with the longer ramp. The present invention is a new and improved spill control system which allows for independent control of fuel delivery and timing advance in the fuel injection pump.

An additional problem associated with the incorporation of a spill control system into a fuel injection pump, especially pumps employed for diesel injection applications, results from the wide range of fuel spilling velocities and in particular the potential adverse operational characteristics associated with relatively high fuel spilling velocities and relatively low fuel spilling velocities. In general, the spilling velocity of the fuel is a function of the pressure differential between the pressure of the fuel which is to be diverted and the pressure of the environment into which the fuel will be diverted. High spilling velocities which result from high pressure differentials create cavitation in the injection pump system. However, relatively low spilling velocities retard the nozzle needle closing which may create additional problems regarding emissions and fuel consumption. During the course of operating a fuel injection pump, obtaining the optimum compromise between high and low spill velocities is difficult because the pressures generated by the fuel injection pump vary with the pump speed. The spill control system of the present invention provides a new and improved means for controlling the spill velocity in accordance with the speed variations of the pump.

BRIEF SUMMARY OF THE INVENTION

Briefly stated, the invention in a preferred form is a spill control system for a fuel injection pump of a type adapted to deliver discrete charges of pressurized fuel to the cylinders of an associated internal combustion engine. A rotor is rotatably mounted within a housing and includes a pump chamber for receiving charges of fuel. A set of reciprocal plungers are mounted in the chamber for pressurizing the fuel charges. A fuel distributor passage communicates with the chamber for delivering charges of pressurized fuel to the associated engine. A spill passage communicates with the pump chamber. A cam ring operatively engageable with the plungers reciprocates the plungers upon rotation of the rotor to pressurize fuel charges received in the chamber. The cam ring is angularly adjustable relative to the housing to control the timing of reciprocation of the plungers. A second spill passage communicates with the spill passage in the rotor for diverting pressurized fuel into the interior of the housing. A spill valve variably controls the passage of fuel from the second spill passage into the housing interior. The spill valve includes a valve member which is axially positionable for selectively closing the second spill passage to the passage of fuel and is angularly adjustable to variably control the quantity of fuel diverted into the housing interior. A valve actuator which is actuable to control the axial position of the valve member is angularly adjustable with the cam ring for regulating the timing of the actuator in accordance with the reciprocation of the plungers.

The valve actuator preferably includes an axially reciprocating pin received in the cam ring and axially engageable for positioning the valve member. The pin is engageable with the cam surface which is rotatable with the rotor so that upon rotation of the rotor, the pin is axially displaced. Fuel under a transfer pressure is employed to urge the valve member axially toward the actuator pin. A check valve is employed to prevent the passage of fuel into the housing interior unless the pressurized fuel exceeds a threshold pressure in excess of the maximum transfer pressure of the pump. The valve member in a preferred form has three land portions which define a pair of annulus shaped passages which are axially alignable for fuel communication through the second spill passage. At least one of the annulus passages preferably has a helically shaped edge. Control means are provided to control the angular position of the valve member.

In a second embodiment of the spill valve, the valve member includes a spill annulus and an axial bore which communicates with the spill annulus. A ball valve controlled by fuel under a transfer pressure is seatable for closing the axial bore to the passage of fuel. In a third embodiment of the spill valve, the valve member includes a spill annulus and an axial bore communicating with the spill annulus and leading to a fuel chamber which is interiorly formed in the valve member. A fuel return plug expels diverted fuel from the fuel chamber for redirecting the spilled fuel through the spill passages.

An object of the invention is to provide a new and improved spill control system for a fuel injection pump which system is adjustable for controlling the diverting of pressurized fuel for achieving a high level of operation over wide ranges of load and speed conditions.

Another object of the invention is to provide a new and improved spill control system for a fuel injection pump wherein the fuel delivery and advance timing may be independently adjusted and accurate control of the fuel charge delivered to the associated internal combustion engine is achieved.

A further object of the invention is to provide a new and improved spill control system for a fuel injection pump wherein the velocity of the diverted fuel is variably controlled to prevent cavitation in the pump.

Another object of the invention is to provide a new and improved spill control system for a fuel injection pump wherein the quantity of diverted fuel may be accurately controlled for reliably regulating the delivery of pressurized fuel charges to an associated internal combustion engine.

Other objects and advantages of the invention will become apparent from the accompanying drawing and specification.

DETAILED DESCRIPTION OF THE INVENTION

Figure 1:
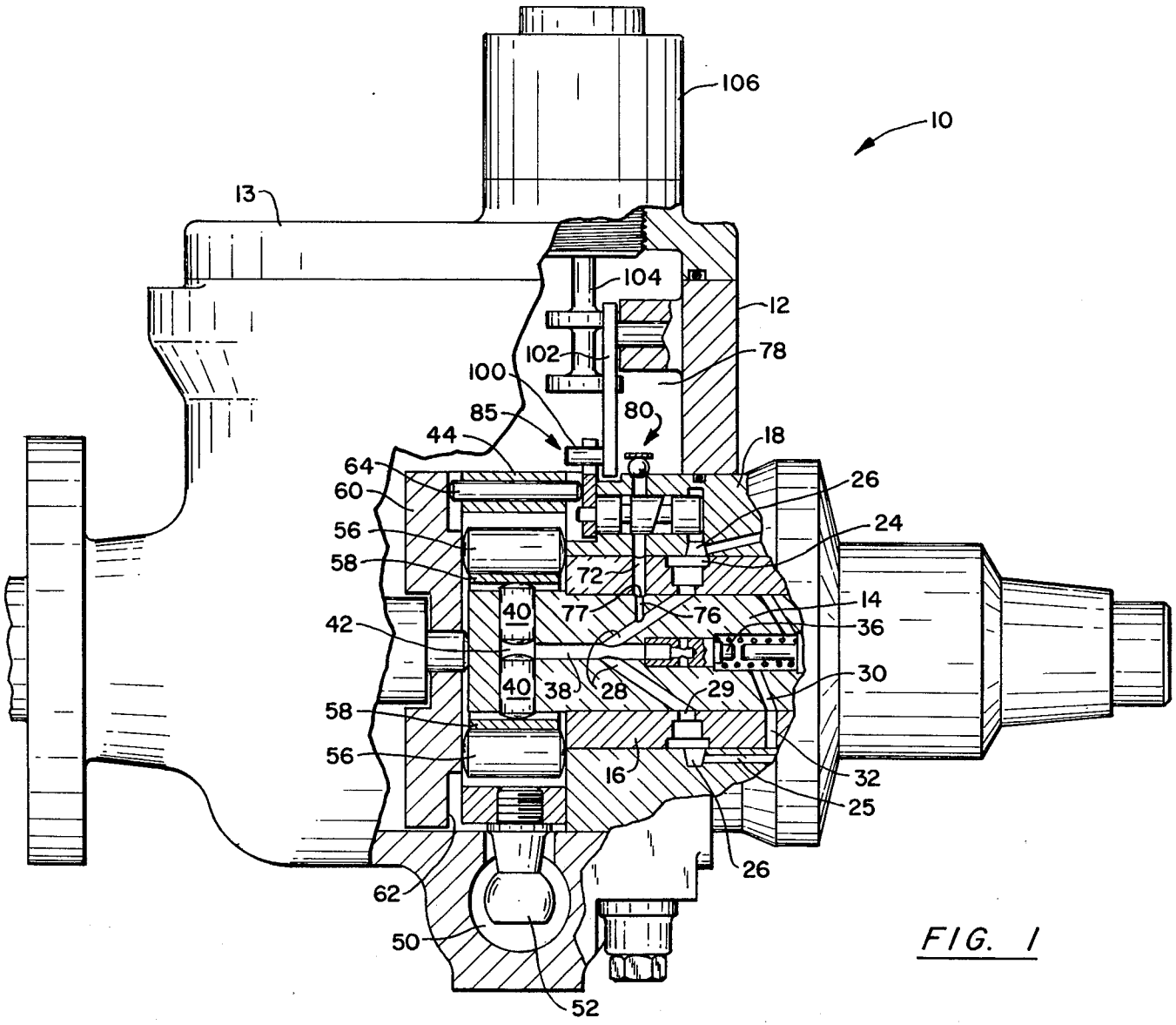
FIG. 1 is a side view, partly broken away and partly in section, of a fuel injection pump employing the spill control system of the present invention.

With reference to the drawing wherein like numerals represent like parts throughout the figures, a fuel injection pump incorporating the spill control system of the present invention is generally designated by the numeral 10. Fuel injection pump 10, excepting for the spill control system, is exemplary of commercially available pumps which are employed with compression ignition or diesel engines for delivering pressurized charges of fuel to the cylinders of associated engines. The pump 10 includes a housing 12 having a cover 13 and a distributor rotor 14 journaled within a fuel distributor sleeve 16 of a hydraulic distributor head 18 of the pump housing 12.

A low pressure vane-type transfer pump (not illustrated) is provided at one end of the rotor 14. The transfer pump has an inlet to which fuel is supplied from a fuel reservoir (not illustrated). The outlet of the transfer pump is connected to a fuel inlet annulus 24 in the sleeve 16 via a passage 25 and an annulus 26 in the hydraulic distributor head 18. Transfer pump is driven by the rotor 14 and generally functions to provide a transfer pump output pressure for delivering fuel to the injection pump for pressurization thereof. The transfer pump output pressure generally increases with engine speed in order to meet the increased fuel requirements of the associated engine at higher speeds and also to provide a fuel pressure usable for operating auxiliary mechanisms of the fuel injection pump.

The rotor 14 has a pair of diagonal fuel inlet passages 28 and a fuel discharge passage 30. As the distributor rotor 14 rotates, the inlet passages 28 register sequentially with a plurality of radial ports 29 (only one of which is illustrated) uniformly angularly spaced in sleeve 16 in a plane of rotation of the inlet passages 28 to provide periodic communication by the fuel inlet annulus 24 with the inlet passages 28 for supplying fuel to the rotor 14. The discharge passage 30 communicates sequentially with a plurality of fuel outlet passages 32 (only one of which is illustrated). The fuel outlet passages 32 are uniformly angularly spaced around the sleeve 16 in the plane of rotation of the discharge passages 30 so that upon rotation, the distributor rotor 14 sequentially delivers pressurized fuel charges to a plurality of fuel connectors for delivery of the pressurized fuel charges to the respective fuel injection nozzles of the associated engine (not illustrated) for injection of fuel charges into the engine cylinders. A delivery valve 36 is mounted within an axial passage 38 in the rotor 14 to control the back flow of pressurized fuel from the discharge passage 30 after the fuel charge injection.

The rotor 14 has an enlarged, generally cylindrical portion with a diametral bore receiving a pair of diametrically opposed pumping plungers 40. The space between the inner ends of the plungers 40 forms a high-pressure pump chamber 42. Pump chamber 42 communicates with the inlet passages 28 and the discharge passages 30 via axial passage 38 to alternately receive and discharge fuel as the distributor rotor 14 rotates.

Figure 2:
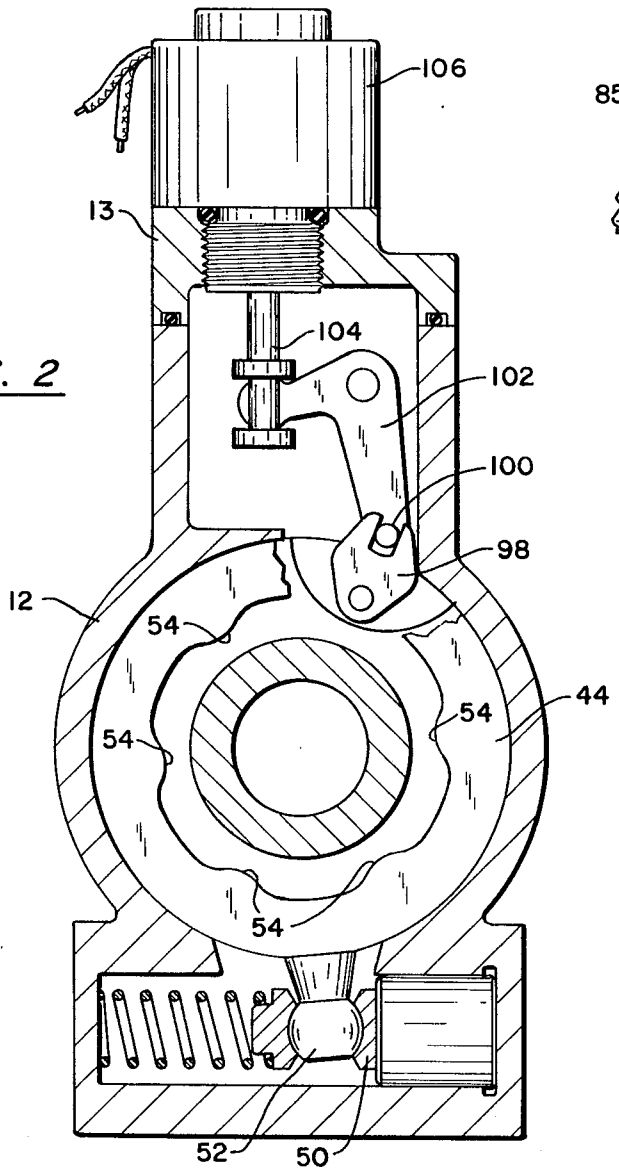
FIG. 2 is a transverse sectional view, partly broken away, partly in section, and partly in schematic, of the spill control system of FIG. 1.

Surrounding the plungers 40 in the plane of revolution thereof is a generally annular cam ring 44. The cam ring 44 is mounted in the housing 12 for limited angular movement. The angular position of the cam ring 44 is controlled by a timing or advance piston 50 which is mechanically connected to the cam ring 44 by a connector pin 52. With reference to FIG. 2, the cam ring 44 has an inner annular cam surface with a plurality of pairs of diametrically opposed, inwardly projecting cam lobes 54 for actuating the plungers 40 inwardly to pressurize the charge of fuel supplied to the pump chamber 42. A roller assembly comprising a roller 56 and a roller shoe 58 is disposed between each plunger 40 and the cam ring 44 so that the rollers 56 follow the cam surface to translate the cam contour into reciprocal movement of the plungers 40. The position of timing piston 50 determines the angular position of the annular cam ring 44 for timing the distribution of fuel to the fuel nozzles of the associated engine in correlation with the engine operation. The position of the timing piston 50 may be controlled by any of a number of known timing mechanisms, such as for example the timing mechanism disclosed in U.S. Pat. No. 3,771,506. A general form of the timing mechanism is illustrated schematically in FIG. 2 and FIG. 4.

A generally annularly-shaped cam plate 60 is rotatably coupled to the distributor rotor 14 at a forward end thereof. Cam plate 60 has a circular cam surface 62 which faces rearwardly in the injection pump. Cam ring 44 further includes an axial bore which receives an axially positionable actuator pin 64. Actuator pin 64 is positionable so that a forward end engages the cam surface 62. As the distributor rotor 14 and hence the cam plate 60 rotates, the cam contour of contour surface 62 is translated into axial reciprocation of the actuator pin 64 as will be more fully described below.

An axially extending bore 66 is formed in the distributor head 18. Bore 66 is generally cylindrical with an enlarged rearward portion defining a transfer pressure chamber 68. Transfer pressure chamber 68 communicates via annulus 26 with inlet annulus 24 to receive fuel under a transfer pressure. A pair of aligned spill passages 72 and 74 intersect axial bore 66 and extend transversely therefrom. Spill passage 72 extends through the distributor sleeve 16. The distributor rotor 14 includes a generally radially extending spill passage 76 which communicates with a diagonal inlet passage 28. Spill passage 76 continuously communicates with annulus 77 formed at the periphery of the rotor and is rotatably alignable with spill passage 72 of the distributor sleeve 16. Spill passages 72 and 74, annulus 77, and spill passage 76 thus cooperate to form a spill path leading from axial passage 38 to an interior spill cavity 78 formed in the interior of housing 12.

A check valve 80 is located at the outlet of spill passage 74. Check valve 80 includes a ball 82 which is seated by a leaf spring 84 to normally close fuel communication between spill passage 74 and spill cavity 78. Spring 84 is preloaded so that the opening pressure of check valve 80 is on the order of 150–200 p.s.i., which pressure is greater than the maximum transfer pressure in the injection pump. The latter minimum pressure is maintained to prevent the formation of fuel vapor in the rotor during spilling of the fuel, to assure uniform delivery during sequential pumping strokes, and to prevent cavitation. Another check valve (not illustrated) may be mounted to the cover 13 of the housing to allow the fuel which is diverted to the interior of the housing to return to the fuel tank supply. The latter check valve preferably maintains a fuel pressure of 8–10 p.s.i. in the interior of the housing.

Spill valve 85 includes an elongated valve member 86 which is slidably received in axial bore 66 for axial movement therein. Valve member 86 is generally cylindrical shaped and includes two axially spaced spill annuli 88 and 90 which are formed between land segments 92, 94, and 96. Land segments 92 and 96 are closely received in the axial bore 66 to form a generally fluid tight sealing engagement with the bore. The end of land segment 92 is exposed to fuel under transfer pressure in transfer pressure chamber 68. The transfer pressure of the fuel urges the valve member 86 in a generally forward direction (toward the left as viewed in FIG. 1). The intermediate land segment 94 has a flat which defines a fluid passageway between annulus 88 and annulus 90. The forward land segment 96 functions to seal the forward portion of axial bore 66. It will be appreciated that valve member 86 may be displaced forwardly so that spill passages 72 and 74 are in fluid communication via spill annulus 88. Similarly, valve member 86 may be displaced rearwardly so that spill passages 72 and 74 are in fluid communication via spill annulus 90. Helically shaped control edges 89 and 91 of land segment 94 partially define spill annuli 88 and 90, respectively. Control edges 89 and 91 are configured and spaced so that the axial width of the annuli varies in accordance with the angular position of valve member 86.

Figure 3:
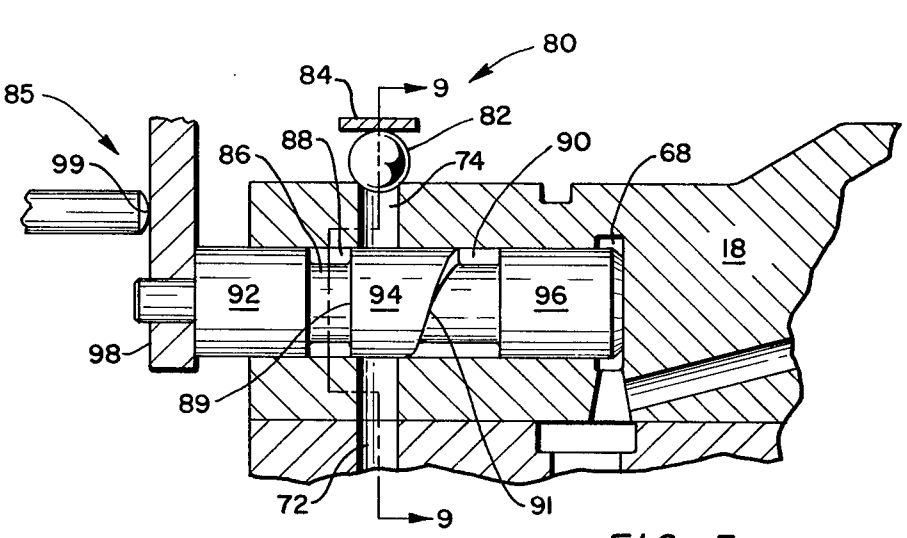
FIG. 3 is an enlarged fragmentary sectional view showing a spill valve employed with the spill control system of FIG. 1.
Figure 9:
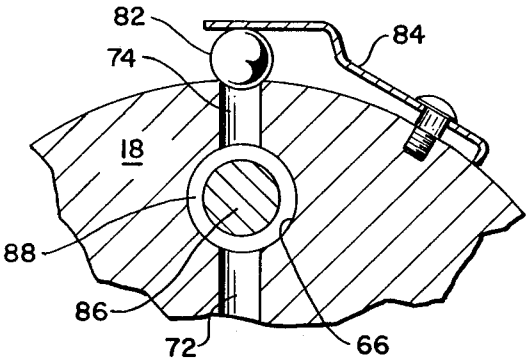
FIG. 9 is an enlarged partial transverse sectional view, partly broken away, showing a pressure relief valve of the spill control system.

A lever plate 98 is mounted at the forward end of valve member 86 in a fixed angular orientation relative thereto. Lever plate 98 is configured so that the rear end of actuator pin 64 engages against the front face of the plate along an arcuate path (illustrated by broken lines in FIG. 3). The extending portion of lever plate 98 forms a catch for receiving a connector pin 100 which axially projects from a bell crank 102 as illustrated in FIG. 2. Bell crank 102 is connected to a linear actuating arm 104 for pivotal movement to control the angular position of plate 98 and hence valve member 86. It will be appreciated that valve member 86 functions to variably control the passage of fuel from spill passage 72 to spill passage 74 in accordance with both the axial position of the valve member and the angular position of the valve member. The angular position of the valve member determines the opening widths defined by helical control edges 89 and 91 and hence the quantity of fuel which may be allowed to pass through the spill passage for a given axial position. The linear actuating arm may be controlled by a solenoid or stepper motor (designated generally as 106) which is mounted to the housing cover 13.

It will be appreciated that the quantity of fuel in the pressurized charges delivered to the internal combustion engine is inversely related to the quantity of fuel which is diverted to the housing interior. Under certain engine operating conditions such as where a rapid acceleration is required, little or no fuel is initially diverted and full fuel charges are supplied to the engine. Subsequently, the angular position of the valve member may be adjusted to increase the quantity of diverted fuel and thus trim the quantity of fuel in the supplied charges.

Figure 4:
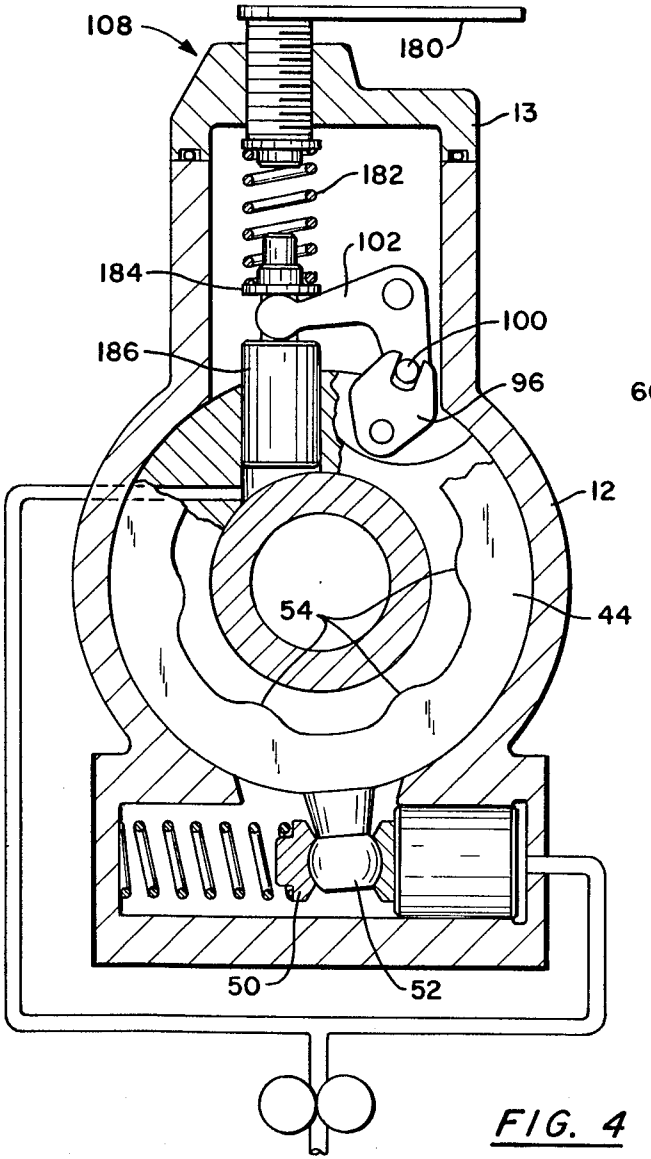
FIG. 4 is a transverse view, partly in section, partly broken away, and partly in schematic, of an alternate embodiment of a spill control system.

In an alternate form of the invention as illustrated in FIG. 4, the angular position of the valve member may be controlled by a mechanical governor 108 which is coupled to the bell crank 102 for pivotal drive thereof. A throttle lever 180 responsive to the engine throttle position is angularly positionable to vary the bias of spring 182. The driven end of bell crank 102 is captured between a retainer plate 184 biased by spring 182 and a piston 186 which is opposingly biased by fuel under transfer pressure. The pivotal position of bell crank 102 and hence the angular position of valve member 86 is determined by the pressure differential exerted between the throttle or load related spring bias and the speed related transfer pressure exerted on the piston.

In operation, the distributor rotor 14 is driven by the associated engine (not illustrated) via the pump drive shaft 110. The rotor 14 drives the transfer pump 20 so that low pressure fuel is delivered through inlet annulus 24 and inlet passages 28 of the rotor to the pump chamber 42. Fuel under a relatively low pressure is also transmitted to the transfer pressure chamber 68. The opposed rollers 56 are angularly disposed with respect to the cam lobes 54 of the cam ring 44 so that the plungers 40 move radially upwardly in synchronism with the registry of an inlet passage 28 with an inlet port to allow fuel to enter the pumping chamber 42. As the distributor rotor 14 continues its rotation, the inlet passage 28 moves out of registry with the port and the plungers 40 are actuated inwardly by a pair of opposed cam lobes 54 to produce a high-pressure fuel pulse in the pump chamber 42. At the same time, the discharge passage 30 moves into registry with a delivery passage 32 which communicates with one of the engine cylinders (not illustrated) for delivery of a high-pressure fuel pulse to the respective fuel injection nozzles for injection of a fuel charge into the engine cylinder. In addition, a portion of the pressurized fuel spills is diverted into the spill passage 76 of the rotor and flows via annulus 77 into spill passage 72. A portion of the pressurized fuel charge delivered from axial passage 38 is spilled or diverted into the spill passage 72 and ultimately to spill cavity 78 of the housing in accordance with the axial and angular position of spill valve member 86 and the pressure of the spilled fuel. Thus, the quantity of fuel ultimately delivered to a fuel injection nozzle (not illustrated) of the associated engine (not illustrated) can be accurately variably controlled.

The passage of fuel through spill valve 85 is controlled by the axial position of valve member 86 which generally defines either an opened position or a closed position. During the operation of the injection pump, valve member 86 continuously axially reciprocates. The axial position of valve member 86 is determined by the effective pressure differential between the transfer pressure in transfer chamber 68 which urges the valve member forwardly and the engagement pressure exerted by the actuator pin against the link plate 98 which forces the valve member rearwardly. As the distributor rotates, the cam surface 62 which is synchronized with the lobes of the cam ring, cooperates with the return force exerted by fuel in the transfer chamber to actuate the actuator pin 64 axially in periodic reciprocating fashion so that annulus 90 of the valve member 86 is periodically urged into communication with spill passages 72 and 74. Because the actuator pin 64 is carried by the cam ring 44, the control of fuel delivery via the spill valve does not change when the timing of fuel injection is either advanced or retarded by means of the timing control piston 50. The engagement of the end of the actuator pin 64 with the lever plate 98 essentially defines an arcuate contact path for all of the advance and retard positions of the timing control piston.

In one embodiment of the spill valve, both spill annulus 88 and spill annulus 90 are alignable with spill passage 72 so that the fuel delivery can be controlled by both pre-spilling or diverting the fuel (via annulus 88) relative to the peak pumping force wherein the rollers engage the cam lobe nose, and also post-spilling or diverting fuel (via annulus 90) subsequent to the engagement of rollers with the cam lobe nose. The quantity of diverted fuel is regulated by means of the angular position of valve member 86 and the specific control edge configurations defining each of the spill annuli 88 and 90. The angular position of the valve member is automatically controlled via lever plate 98 and bell crank 102 by means of either electronic or mechanically controlled means responsive to operational characteristics of the associated engine.

The foregoing described spill valve arrangement produces contact forces between the actuator pin 64 and the cam surface 62 and between actuator pin 64 and the lever plate 98 which are commensurate with the actual operational requirements of the injection pump. The transfer pressure of fuel in the transfer pressure chamber 68 increases with the increase in speed of the pump. Consequently, the transfer pump pressure functions to provide a substantially backlash free contact between the actuator pin and the cam surface and the lever plate. At relatively low speeds and consequently low transfer pressures, the forces of contact are relatively low, and at relatively high speeds wherein the higher acceleration forces would tend to separate the actuator pin contact, the forces of contact are relatively high.

The check valve 80 is employed to increase the spilling pressure for diverting the pressurized fuel into the housing and to thereby reduces the fuel spilling velocity. The check valve 80 thus requires cavitation which is created by the inertial forces of the spilled fuel. The opening pressure of the check valve 80 is greater than the maximum transfer pressure of the pump.

Accurate control of the delivered pressurized fuel charge by diverting fuel into the housing may be achieved by adjusting the angular position of the valve member. The helical edges 89 and 91 of the valve member 86 are configured so that selective angular adjustment of valve member 86 provides a variably selective restriction between spill passages 72 and 74 whereby quantities of diverted fuel may be further regulated. The angular position of valve member 86 is controlled either by an electronically actuated stepper motor or a solenoid which is responsive to various engine operating parameters such as, for example, speed, load, or temperature or by a mechanically controlled governor assembly of a type such as disclosed in U.S. Pat. No. 4,142,499 entitled "Temperature Compensated Fuel Injection Pump" which is responsive to speed, load, and temperature.

Figure 5:
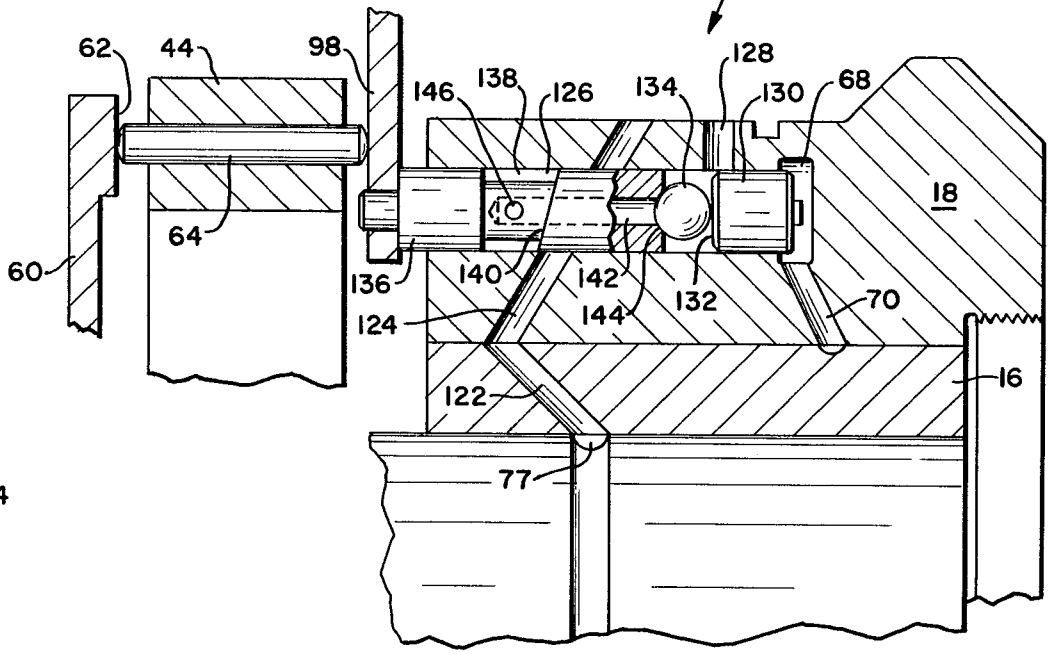
FIG. 5 is a fragmentary side view, partly in section and partly broken away, illustrating a second embodiment of a spill valve for the spill control system of FIG. 2.

With reference to FIG. 5, an alternate spill control valve embodiment is generally designated by the numeral 120. Spill control valve 120 is actuable by actuator pin 64 and cam surface 62 in a manner analogous to that of spill control valve 85. Spill control valve 120 is also angularly positionable by means of a lever plate 98 for variably controlling the quantity of spilled fuel in a manner analogous to that for spill control valve 85. Annulus 77 continously communicates with a diagonal spill passage 122 formed in the distributor sleeve. Spill passage 122 communicates with spill passage 124 formed by a diagonal bore in distributor head 18. An axial bore 126 formed in distributor head 18 opens into transfer pressure chamber 68 which receives fuel under a transfer pressure via transfer passage 70. Diagonal spill passage 124 intersects axial bore 126. A radially extending spill bore 128 leads from axial bore 126 to the interior leak cavity of the housing.

A valve plug 130 is slidably received in axial bore 126 for limited axial movement at the interior end thereof. One end of valve plug 130 is exposed to the transfer pressure fuel in chamber 68. The opposite end of valve plug 130 is contoured to form a seat 132 for retaining a check valve ball 134. An elongated valve member 136 is slidably received in axial bore 126. Valve member 136 forms a spill annulus 138 which is partially defined by a helical edge 140. Valve member 136 further includes an axial bore 142 which opens through the inner end of the valve member. A seat 144 is also formed at the inner end of the valve member for seating check valve ball 134. A radial spill bore 146 connects axial bore 142 with spill annulus 138. The spill path configuration for spill control valve 120 leads from annulus 77 through spill passages 122 and 124, annulus 138, radial spill bore 146, axial bore 142, an intermediate portion of axial bore 126, and spill bore 128, to the leak cavity interior of the housing.

In operation, the spill control valve 120 functions to control the diverting of fuel into the housing in accordance with the axial and angular position of valve member 136 and the pressure differential between the injection pressure of the diverted fuel and the speed correlated transfer pressure, which pressure differential functions to unseat check valve ball 134. The spilling velocity of the diverted fuel in a fuel injection pump is a function of the pressure differential between the injection pressure of the diverted fuel and the pressure of the environment into which the diverted fuel is diverted. Inertial forces engendered from relatively large fuel spilling velocities due to high pressure differentials create cavitation in the fuel injection pump. On the other end of the spectrum, relatively spilling velocities of the fuel retard nozzle needle closing which creates potential adverse emissions and fuel consumption characteristics for diesel engine applications. The optimum spill velocity in a fuel injection pump is difficult to obtain because the pressures generated by the injection pump tend to vary with the pump speed. Because the spill control valve 120 has an opening pressure which varies with speed, the opening pressure of the spill valve will be relatively low at relatively low engine speeds when injection pressure is also low and relatively high at high engine speeds when the injection pressure is also relatively high. Check valve ball 134 is controlled by valve plug 130 which is axially responsive to the speed correlated transfer pressure in chamber 68. Because of effective area differences, the opening pressure of the spill valve will always be higher than the transfer pump pressure. Consequently, the pump chamber 42 can commence filling immediately when a roller passes the cam lobe nose of a cam ring, although the spill valve edge is still in an open position. These latter characteristics allow for an increase in the filling angle of the rotor and would essentially allow for a reduction in the rotor diameter with consequent benefits regarding leakage clearance, length, and lower peripheral velocity of the rotor.

Figure 6:
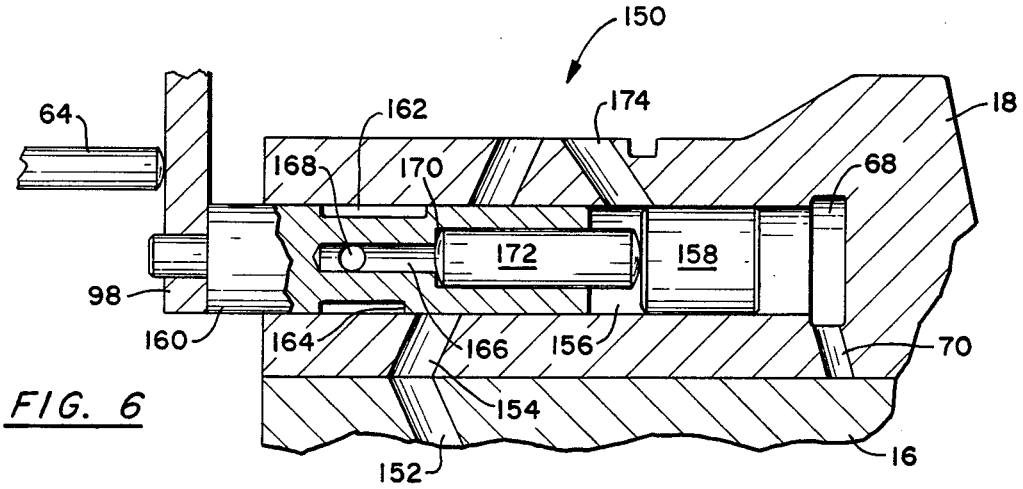
FIG. 6 is a fragmentary side view, partly in section and partly broken away, illustrating a third embodiment of a spill valve for the spill control system of FIG. 2.
Figure 7:
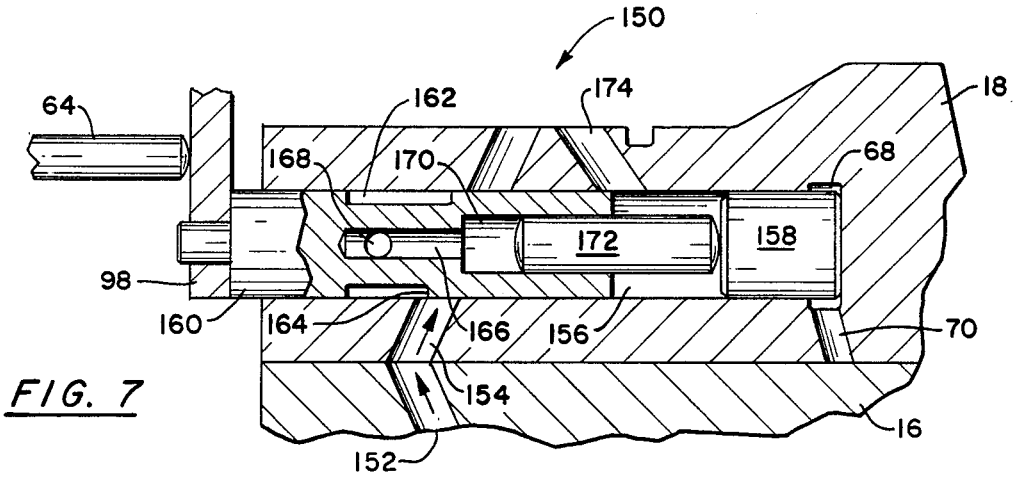
FIG. 7 is a fragmentary side view, partly in section and partly broken away of the spill valve of FIG. 6, illustrating a second operational position.
Figure 8:
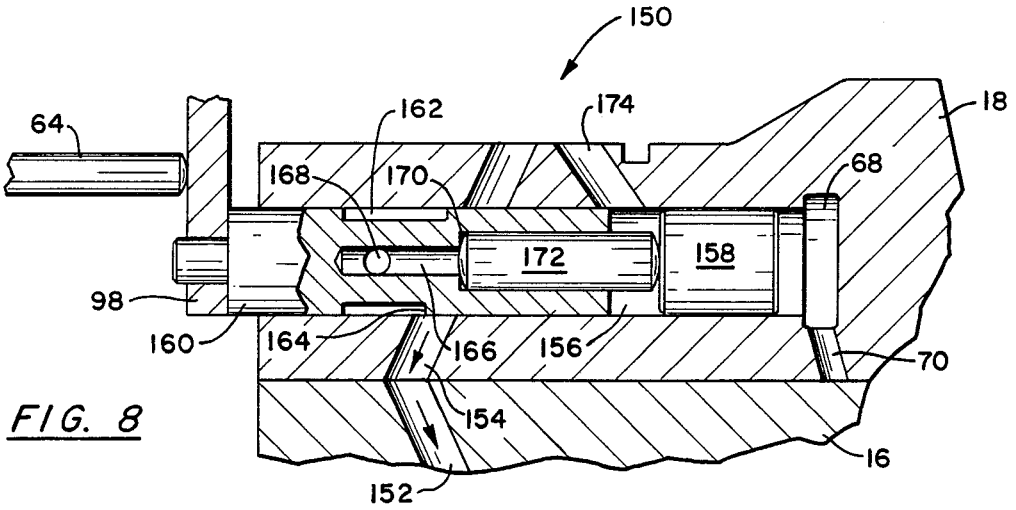
FIG. 8 is a fragmentary side view, partly in section and partly broken away, of the spill valve of FIG. 6 illustrating a third operational position.

With reference to FIG. 6, FIG. 7, and FIG. 8, a spill control valve of a recouping type is designated generally by the numeral 150. The recouping spill control valve 150 is actuated and governed for axial and angular positioning in a manner analogous to that for valves 85 and 120. Rather than allowing fuel to leak to the housing, spill control valve 150 essentially returns the diverted fuel to the inlet passage of the rotor.

A diagonal spill passage 152 in the distributor sleeve connects with a diagonal spill passage 154 in the distributor head. An axial bore 156 in the distributor head includes at one end transfer pressure chamber 68. A valve plug 158 is slidably received in axial bore 156 for axial movement therein. One end of the valve plug is exposed to the transfer pressure fuel under a transfer pressure in chamber 68. An elongated valve member 160 which may be axially and angularly controlled in a manner analogous to that for valve member 136 and 86 is slidably received in axial bore 156. Valve member 160 forms a spill annulus 162 partially defined by a helical edge 164. A stepped axial bore 166 radially connects with a spill bore 168 which connects with spill annulus 162. The enlarged outer portion of axial bore 166 forms a spill chamber 170 which closely slidably receives an axially displaceable valve pin 172. The inner end of valve pin 172 is exposed to spilled fuel in spill chamber 170 under an injection pressure. The outer end of valve pin 172 is engaged by a piston 158. Piston 158 is axially displaceable in accordance with the pressure differential between the fuel in spill chamber 170 and fuel in transfer pressure chamber 68. The intermediate portion of axial bore 156 communicates via diagonal passage 174 with the housing interior. With specific reference to FIG. 6, during fuel delivery of the fuel injection pump, the speed correlated transfer pressure in chamber 68 forces piston 158 to fully seat valve pin 132 in spill chamber 170. The spill annulus 162 is axially out of communication with spill passage 154.

With reference to FIG. 7, during the inward actuation of the pumping plungers, pressurized fuel is forced through spill passage 152 to spill passage 154 in the direction of the arrow of FIG. 7. The actuator pin 64 is axially displaced for actuating valve member 160 by axial displacement (to the right in FIG. 7.) Consequently, valve member 160 is axially displaced so that spill annulus 162 communicates with spill passage 154. The diverted fuel under an injection pressure enters axial bore 166 via spill bore 168 and as the injected fuel pressure exceeds that of the transfer pressure, valve pin 172 is displaced from the spill chamber 170 by the received diverted fuel.

At the end of the injection stroke, the transfer pressure exceeds that of the pressure of the diverted fuel. With reference to FIG. 8, the valve pin is accordingly axially displaced to expel the diverted fuel from the spill chamber 170 through axial bore 166, spill bore 168, annulus 162, spill passage 154 and spill passage 152 back to the inlet passage of the rotor (in the direction of the arrows of FIG. 8). Consequently, rather than diverting fuel to the housing, the diverted fuel is received in chamber 170 and returned to the fuel inlet passage in the rotor. In this latter embodiment, the spill velocity of the diverted fuel is correlated with the pressure differential between the fuel injection pressure and transfer pressure of the pump.

The foregoing spill control system for a fuel injection pump has been set forth for purposes of illustration. The foregoing description should not be deemed a limition of the invention herein. Accordingly, various modifications, adaptations, and alternatives may occur to one skilled in the art without departing from the spirit and scope of the present invention.

What is claimed is:

1. A fuel injection pump adapted to deliver discrete charges of pressurized fuel to the cylinders of an associated internal combustion engine comprising:

a housing;

a rotor rotatably mounted within said housing and including a pump chamber for receiving charges of fuel, a set of reciprocable plungers mounted in said chamber for pressurizing the fuel charges, a fuel distributor passage communicating with said pump chamber for delivering charges of pressurized fuel to the associated engine, and a spill passage communicating with said pump chamber;

a cam ring operatively engageable with said plungers for reciprocating said plungers upon rotation of said rotor to pressurize fuel charges received in said pump chamber, said cam ring being angularly adjustable relative to said housing to control the timing of reciprocation of said plungers;

spill passage means communicating with said spill passage to divert pressurized fuel into the interior of said housing;

spill valve means to variably control the passage of fuel from said spill passage means into said housing interior, said spill valve means including a valve member which is axially positionable for selectively closing the spill passage means to the passage of fuel therethrough and angularly adjustable to variably control the quantity of fuel diverted into the housing interior; and valve actuator means actuable to control the axial position of said valve member, said valve actuator means being angularly adjustable with said cam ring for regulating the timing of the actuator means in accordance with the reciprocation of the plungers;

2. The fuel injection pump of claim 1 wherein the valve actuator means includes an axially moveable pin received in said cam ring and axially engageable for positioning said valve member.

3. The fuel injection pump of claim 2 wherein the valve actuator means further includes a cam plate rotatable with the rotor and forming a cam surface, said pin engageable with said cam surface so that upon rotation of the rotor, the pin is axially displaced.

4. The fuel injection pump of claim 1 further comprising a transfer pump driven by said rotor for receiving fuel from a fuel reservoir and delivering fuel under transfer pressure to the pump chamber in said rotor and to a transfer pressure chamber, said valve member being urged to an axial position by the transfer pressure of fuel in said transfer pressure chamber.

5. The fuel injection pump of claim 1 further comprising a check valve means to selectively prevent the passage of fuel into the housing interior.

6. The fuel injection pump of claim 1 further comprising a control means to control the angular position of the valve member, the control means comprising a connector arm mounted to the valve member and a bell crank connecting the arm, said bell crank being pivotal to control the angular position of the valve member.

7. The fuel injection pump of claim 6 wherein the control means further comprises a stepper motor having a linear drive arm, the bell crank being pivotally governed by said drive arm.

8. The fuel injection pump of claim 6 wherein the control means further comprise a solenoid actuating a linear drive arm, the bell crank being pivotally governed by the drive arm.

9. The fuel injection pump of claim 7 wherein the pivotal position of the bell crank is controlled by means of a hydraulic governor.

10. The fuel injection pump of claim 1 wherein the valve member is received in a cylindrical bore, said valve member having three land portions defining a pair of annulus shaped passages axially alignable for fuel communication through said spill passage means.

11. The fuel injection pump of claim 10 wherein at least one annular passage has a helically shaped edge.

12. The fuel injection pump of claim 4 wherein the valve member has an annulus and an axial bore leading from said annulus, said pump further comprising a check valve means to control the flow of fuel from said axial bore.

13. The fuel injection pump of claim 12 wherein the check valve means includes a ball which is seatable against said valve member by means of transfer pressure exerted by fuel in said transfer pressure chamber.

14. A fuel injection pump adapted to deliver discrete charges of pressurized fuel to the cylinders of an associated internal combustion engine comprising:

a housing;

a rotor rotatably mounted within said housing and including a pump chamber for receiving a charge of fuel, a set of reciprocable plungers mounted in said chamber for pressurizing a fuel charge a fuel distributor means communicating with said chamber for delivering a pressurized fuel charge to the associated engine;

plunger actuating means operatively engageable with said plungers to reciprocate said plungers upon rotation of said rotor to pressurize the fuel charge received in said chamber, said plunger actuating means being adjustably positionable to control the timing of reciprocation of said plungers;

spill passage means communicating with said pump chamber to selectively divert a portion of the pressurized fuel charge;

spill valve means comprising a valve member axially positionable to control the diverting of fuel by said spill passage means;

valve actuator means operable upon the rotation of said rotor to actuate said spill valve means in synchronization with the timing of reciprocation of said plungers.

15. The fuel injection pump of claim 14 wherein the plunger actuating means comprises a cam ring angularly adjustable relative to said housing and the valve actuator means comprises an actuator pin mounted to said cam ring, the axial position of said actuator pin being controlled by a cam face rotatable with said rotor.

16. The fuel injection pump of claim 14 wherein the plungers reciprocate along a diametral axis to produce a series of inward plunger strokes and the valve member is axially positionable for diverting pressurized fuel prior to and subsequent to the termination of each inward plunger stroke.

17. The fuel injection pump of claim 14 wherein the spill passage means communicates with the interior of said housing and further comprising a check valve for controlling the flow of fuel from said spill passage means to said housing interior.

18. The fuel injection pump of claim 17 wherein the valve member includes a spill annulus and an axial bore communicating with said spill annulus, a ball valve being seatable for closing said axial bore to the passage of fluid therefrom.

19. The fuel injection pump of claim 14 wherein the valve member includes a spill annulus, an axial bore communicating with said spill annulus and leading to a fuel chamber interiorly formed in said valve member.

20. The fuel injection pump of claim 19 further comprising a fuel return means to expell diverted fuel from said fuel chamber for redirecting said expelled fuel through said spill passage means.

21. A fuel injection pump adapted to deliver discrete charges of pressurized fuel to the cylinders of an associated internal combustion engine comprising:

a rotatably mounted rotor including a fuel inlet passage communicating with a pump chamber for receiving charges of fuel, a set of reciprocable plungers mounted in said chamber for pressurizing the fuel charges and a fuel distributor means communicating with said chamber for delivering charges of pressurized fuel to the associated engine;

transfer pump means driven by said rotor for receiving fuel from the fuel reservoir and delivering fuel under transfer pressure to said fuel inlet passage;

cam means operatively engageable with said plungers to reciprocate said plungers upon rotation of said rotor to pressurize fuel charges received in said chamber, said cam means being angularly adjustable about the axis of rotation of said rotor to control the timing of reciprocation of said plungers.

spill passage means communicating with said inlet passage to selectively divert a portion of the pressurized fuel charges;

spill valve means interposed in the spill passage means to control the passage of fuel in said spill passage means, the spill valve means comprising a valve member which is axially positionable to selectively permit the flow of diverted fuel through said spill passage means; and valve actuator means operable upon the rotation of said rotor to actuate said spill valve means in synchronization with the timing of reciprocation of said plungers.

22. The fuel injection pump of claim 21 further comprising a check valve for controlling the flow of fuel from said spill passage means, the opening pressure of said check valve being greater than said transfer pressure.

23. The fuel injection pump of claim 21 wherein the valve actuator means comprises a cam surface rotatable with said rotor, an actuator pin engageable with said cam surface to control the axial position of said valve member, the transfer pressure being employed to variably control the forces of engagement of said actuator pin with said cam surface and to axially urge said valve member toward said pin.

24. The fuel injection pump of claim 23, wherein the valve member includes a spill annulus and an axial bore communicating with said spill annulus, a check valve controlling the flow of fuel from said axial bore in response to said transfer pressure.

25. The fuel injection pump of claim 23, wherein the valve member includes a spill annulus and an axial bore communicating with said spill annulus and leading to a fuel chamber interiorly formed in said valve member, the volume of fuel in said fuel chamber being variably controlled by a plug responsive to transfer pressure.

26. The fuel injection pump of claim 25 wherein diverted fuel is received in said fuel chamber and redirected to said inlet passage by said plug expelling fuel from said fuel chamber.

27. The fuel injection pump of claim 21 wherein the valve member is angularly adjustable to variably control the quantity of fuel which flows through said spill passage means.

28. The fuel injection pump of claim 27 further comprising automatic control means to control the angular position of said valve member.

* * * * *